US011322056B2

(12) United States Patent
Ahn

(10) Patent No.: US 11,322,056 B2
(45) Date of Patent: May 3, 2022

(54) LUMINOUS STICK OF EMITTING THREE-DIMENSIONAL IMAGE ON THE BASIS OF OPTICAL ELEMENT

(71) Applicant: Je Phil Ahn, Seoul (KR)

(72) Inventor: Je Phil Ahn, Seoul (KR)

( * ) Notice: Subject to any disclaimer, the term of this patent is extended or adjusted under 35 U.S.C. 154(b) by 123 days.

(21) Appl. No.: 16/710,805

(22) Filed: Dec. 11, 2019

(65) Prior Publication Data

US 2020/0327833 A1 Oct. 15, 2020

(30) Foreign Application Priority Data

Apr. 15, 2019 (KR) ..... 10-2019-0043715
Oct. 21, 2019 (KR) ..... 10-2019-0130911

(51) Int. Cl.
*G09G 3/04* (2006.01)
*G09G 3/00* (2006.01)

(52) U.S. Cl.
CPC ..... *G09G 3/001* (2013.01); *G09G 2320/0626* (2013.01); *G09G 2320/0666* (2013.01); *G09G 2330/02* (2013.01)

(58) Field of Classification Search
CPC ..... G09G 3/001; G09G 2320/0666; G09G 2320/0626; G09G 2330/02
See application file for complete search history.

(56) References Cited

U.S. PATENT DOCUMENTS

2002/0146960 A1* 10/2002 Spencer ..... A63H 33/006 401/209
2013/0309940 A1* 11/2013 Miyako ..... A63H 33/22 446/485
2013/0321394 A1* 12/2013 Fisher ..... G09G 3/06 345/419
2014/0152672 A1* 6/2014 Seder ..... G09G 3/005 345/473
2015/0336020 A1* 11/2015 Levy ..... A63H 33/40 446/485
2017/0134721 A1* 5/2017 Byrne ..... H04N 13/393

FOREIGN PATENT DOCUMENTS

JP 2004045694 A 2/2004
JP 2005173212 A 6/2005
JP 3128763 U 1/2007
JP 2013236873 A 11/2013
KR 1020050033355 A 4/2005
KR 1020160122324 A 10/2016

* cited by examiner

*Primary Examiner* — Adam R. Giesy
(74) *Attorney, Agent, or Firm* — Dinsmore & Shohl LLP; Yongsok Choi, Esq.

(57) ABSTRACT

The present invention relates to a luminous stick of emitting an image on the basis of the optical element, and may provide a three-dimensional image according to rotation of a light emitting body, and may perform various applications by displaying a text, an image, and a moving image. In addition, even when performing performance, since the luminous stick may be performed expressions in various by the luminous stick itself, the luminous stick may be performed the performance by a simple operation, and may be used in concert halls and theaters.

10 Claims, 8 Drawing Sheets

LUMINOUS STICK OF EMITTING THREE-DIMENSIONAL IMAGE ON THE BASIS OF OPTICAL ELEMENT

CROSS-REFERENCE TO RELATED APPLICATION

This application claims priority to and the benefit of Korean Patent Application No. 10-2019-0043715 filed in the Korean Intellectual Property Office on Apr. 15, 2019, and No. 10-2019-0130911 filed in the Korean Intellectual Property Office on Oct. 21, 2019 the entire contents of which are incorporated herein by reference.

TECHNICAL FIELD

The present invention relates to a luminous stick of emitting a three-dimensional image on the basis of an optical element, more specifically, the luminous stick capable of providing an image or a text through a three-dimensional light emitting region by forming a spherical three-dimensional light emitting region according to the rotation of a two-dimensional shape line or surface shape light emitting body.

BACKGROUND ART

In the related art, the luminous stick is widely used to refer to a rod shape object in which fluorescent materials are applied or a separate battery is provided to obtain lighting effects, and a cheering tool that displays various colors or has various shapes as a support tool.

When it is used as the cheering tool, it is designed to display specific phrases or have various shapes, but it has a function of emitting light only, and its expression is limited.

In addition, in a case of a performance hall, there are problems that each singer has a predetermined shape or color, so that the shape or color of the singer is changed or difficult to use when cheering for another singer.

In addition, in the related art, there are problems in using or operating that the cheering tool such as the luminous stick is provided according to a designated position, performance is performed by inputting location information in advance, or the like and a new luminous stick is provided every time.

SUMMARY OF INVENTION

Technical Problem

The present invention is to solve the above-mentioned problems of the related art, and can display a text, an image, and a moving image by providing a three-dimensional image through a rotating light emitting body.

In addition, although it has a spherical shape, it can be displayed so that the desired shape is shown through the provided three-dimensional image, and can display the desired image or an image, such that it is possible to perform performances by a simple operation.

Solution to Problem

As a technical means for achieving the above-described technical problem, a luminous stick of emitting a three-dimensional image through the rotation of an optical element according to an embodiment of the present invention includes a light emitting unit; and a handle part of supporting the light emitting unit, in which the light emitting unit includes a light emitting body that emits at least one color and is configured with a line or a surface of a two-dimensional shape, a rotating part that is connected to one end of the light emitting body to rotate the light emitting body in place, and a control unit that generates a control signal for controlling a light emission position at which a specific color is to be emitted and a light emission angle at which the specific color is to be emitted on a rotation shaft in the light emitting body, and provides the control signal to the light emitting body, the light emitting body includes a three-dimensional light emitting region of a three-dimensional shape according to rotation, and the control unit controls the light emission position and the light emission angle so as to view another image of a specific object according to an angle of a person looking at the light emitting body when the specific object is reproduced through the rotation of the light emitting body.

In addition, the present invention may further include a protective case that has a volume wider than that of the three-dimensional light emitting region, and the protective case may be provided with a material which can transmit light emitted from the light emitting body.

The present invention further may further include a battery unit that supplies power to the rotating part and the control unit and be mounted on the handle part, the rotating part may rotate at a frequency of 60 Hz or more, the control unit may be connected with the light emitting body to be rotated by the rotating part, and the handle part may not be rotated.

The light emitting body includes a plurality of sub-light emitting elements, the plurality of sub-light emitting elements are provided at predetermined intervals, and at least two sub-light emitting elements may emit light of different colors, may have a length equal to or longer than the length of a rotation shaft, and may be fixed in a curved shape.

The rotating part includes a rod shape rotating shaft, both ends of the light emitting body are fixed to both ends of the rotating shaft to be able to rotate, and the control unit may collect a rotation angle through a motor for rotating the rotating part, and may provide a control signal to the light emitting body so as to emit a predetermined color at a specific position in the light emitting body when the light emitting body is positioned at a specific rotation angle, according to a predetermined light emission algorithm.

In addition, in a case where it is difficult to collect the rotation angle directly from the motor, the rotating part includes a rotating body and a rotating body peripheral portion including a material having magnetic force on one side configured to surround the rotating body, and the rotating part may set the rotation angle as 0° when the rotating body and the material having the magnetic force are arranged at positions corresponding to each other and may measure the rotation angle based on the set angle.

In addition, the light emission angle is defined based on the rotation angle of the rotating part, and the control unit may provide an animation effect on an image or a text provided through the rotation of the light emitting body or may vary the image or the text by changing the light emission time and the light emission color of the light emitting body even at the same light emission angle, the three-dimensional light emitting region may be formed at some regions on a surface of a three-dimensional structure formed by rotating the light emitting body, the some regions may be formed near the center of the surface of a three-dimensional structure, and may not be formed in one region of an upper portion and one region of a lower portion of the surface of a three-dimensional structure, and the structure may be a structure having a symmetrical shape with respect to a central axis.

In addition, according to an embodiment of the present invention, an apparatus of emitting a three-dimensional image using the rotation of an optical element includes a light emitting body that emits at least one color and is configured with a line or a surface of a two-dimensional shape; a rotating part that is connected to one end of the light emitting body to rotate the light emitting body in place; and a control unit that generates a control signal for controlling a light emission position at which a specific color is to be emitted and a light emission angle at which the specific color is to be emitted on a rotation shaft in the light emitting body, and provides the control signal to the light emitting body, in which the light emitting body includes a three-dimensional light emitting region of a three-dimensional shape according to rotation, and the control unit controls the light emission position and the light emission angle so as to view another image of a specific object according to an angle of a person looking at the light emitting body when the specific object is reproduced through the rotation of the light emitting body.

Advantageous Effects of Invention

The present invention relates to a luminous stick of emitting a three-dimensional image on the basis of an optical element may provide a three-dimensional image according to the rotation of the light emitting body, it may be possible to display a text, an image, and a moving image such that various applications may be possible.

In addition, it is possible to perform expression in various forms in a luminous stick itself even when performing performance, and it may be possible to perform the performance by a simple operation such that the utilization of it in concert halls and theaters may be increased.

In addition, the present invention may be utilized in various fields such as a clock, a calendar, a mobile phone, and a number display, such as a living accessory and an interior accessory, which need to implement a three-dimensional image.

DESCRIPTION OF EMBODIMENTS

Figure 1:
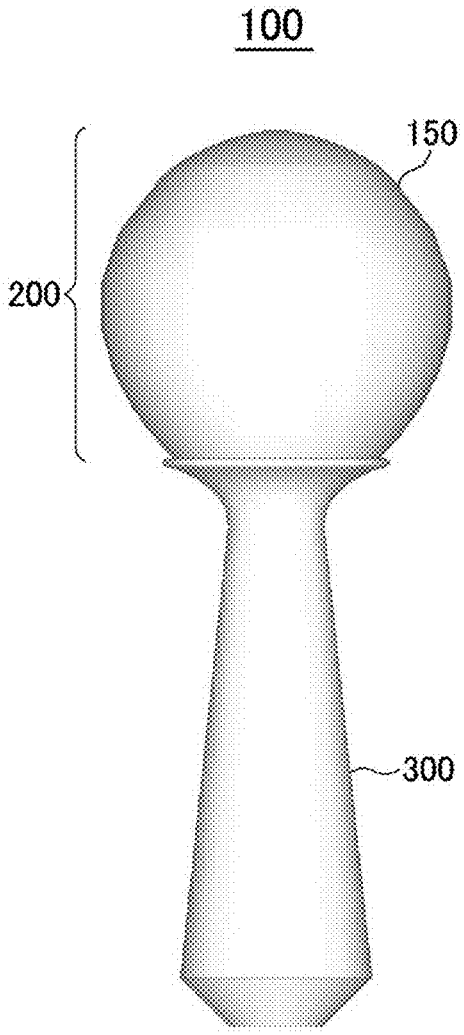
FIG. 1 is an example diagram showing a luminous stick of emitting a three-dimensional image on the basis of an optical element according to an embodiment of the present invention.

Hereinafter, exemplary embodiments of the present invention will be described in detail with reference to the accompanying drawings so that those skilled in the art may easily implement the present invention. However, the invention is not to be implemented in many different forms and limited to the embodiments set forth herein. In the drawings, parts irrelevant to the description are omitted for simplicity of explanation, and like reference numerals designate like parts throughout the specification.

Throughout the specification, when a part is "connected" to another part, this includes not only "directly connected" but also "electrically connected" with another element in between. In addition, when a part is said to "include" a certain component, this means that it may further include other components, except to exclude other components unless otherwise stated.

In the present specification, the term "unit" includes a unit realized by hardware, a unit realized by software, and a unit realized by both. In addition, one unit may be realized using two or more pieces of hardware, or two or more units may be realized by one piece of hardware. Meanwhile, "~unit" is not limited to software or hardware, and "~unit" may be configured to be in an addressable storage medium or may be configured to reproduce one or more processors. Thus, as an example, "~unit" includes components such as software components, object-oriented software components, class components, and task components, and processes, functions, properties, procedures, subroutines, segments of program code, drivers, firmware, microcode, circuits, data, databases, data structures, tables, arrays, and variables. Functionality provided within the components and the "~unit" may be combined into a smaller number of components and the "~unit" or further separated into additional components and the "~unit". In addition, the components and "~unit" may be implemented to play one or more CPUs in a device or secure multimedia card.

In the present specification, a three-dimensional image displayed by a light emitting body 120 may mean a two-dimensional image displayed on a three-dimensional light emitting region 400 of a three-dimensional shape.

Hereinafter, with reference to FIG. 1, the appearance of the luminous stick of emitting a three-dimensional image on the basis of an optical element according to an embodiment of the present invention will be described in detail.

A luminous stick 100 of emitting a three-dimensional image on the basis of an optical element according to an embodiment of the present invention (that is, apparatus of emitting three-dimensional image) may be largely configured with a light emitting unit 200 and a handle part 300, and the handle part 300 may be served as a support unit.

The light emitting unit 200 may further include a protective case 150 that has a volume wider than that of the three-dimensional light emitting region 400, and the protective case 150 may be formed of a material capable of transmitting light emitted from the light emitting body.

The protective case 150 may solve safety issues that may arise due to the rotation of the light emitting body 120. In addition, the protective case 150 may prevent a case in which the light emitting body is broken by an obstacle in contact with the rotation of the light emitting body 120, or the three-dimensional image is not properly reproduced due to the rotation.

In addition, the protective case 150 may be formed to be fixed to the handle part 300 which does not rotate.

Hereinafter, with reference to FIG. 2, the inside of the luminous stick of emitting a three-dimensional image on the basis of an optical element according to the embodiment of the present invention will be described in detail.

The light emitting unit 200 may be configured to include the light emitting body 120 that emits at least one color and is configured with a line or a surface of a two-dimensional shape, a rotating part 110 that is connected to one end of the light emitting body to rotate the light emitting body 120 in place, and a control unit 130 that generates a control signal for controlling a light emission position at which a specific color is to be emitted and a light emission angle at which the specific color is to be emitted in the light emitting body 120, on a rotation shaft, and provides the control signal to the light emitting body 120.

At this time, in the light emitting body 120, the three-dimensional light emitting region 400 of a three-dimensional shape according to the rotation.

When a specific object is reproduced through the rotation of the light emitting body 120, the control unit 130 may control the light emission position and the light emission angle so as to view another image of the specific object according to an angle of a person looking at the light emitting body 120.

In addition, the light emitting body 120 is not limited to the above-described example, and may be provided with a form such as a surface or a line of a two-dimensional shape, and the rotating part 110 may also be provided according to a shape of the light emitting body 120.

For example, the light emitting body 120 may be provided in a "U" shape or an "O" shape. In this case, the rotating part 110 may rotate the light emitting body 120 by being provided at the bottom of the light emitting body 120 of the "U" shape or the "O" shape and connecting to the center of the bottom of the "U" shape or the "O" shape.

At this time, the control unit 130 may be provided inside the light emitting unit 200, and provide a control signal for controlling the light emitting body 120 by being provided at a position close to the light emitting body 120.

In addition, the control unit 130 may be provided by being connected to the light emitting body 120, and it may be possible to rotate the rotating part 110 together with the light emitting body 120 according to the rotation of the light emitting body 120.

When the light emitting body 120 is provided as the "O" shape, the light emitting body 120 may include a circular supporting member in which the optical element is disposed, and the control unit 130 may be mounted on the circular supporting member.

Figure 7:
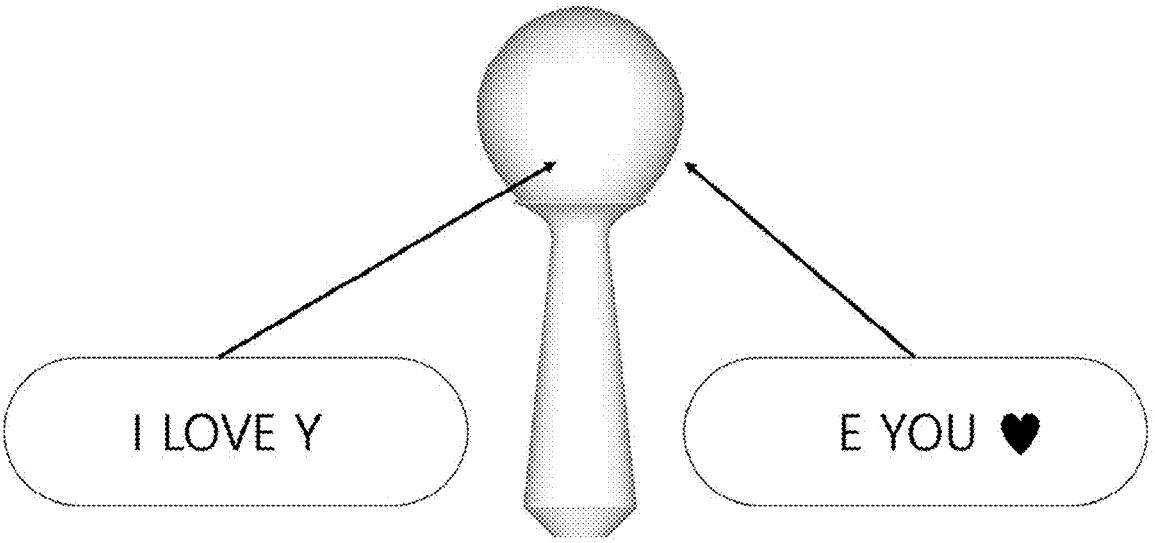
FIG. 7 is an example diagram of an image viewed according to an angle at which an image provided from the luminous stick of emitting a three-dimensional image on the basis of an optical element according to the embodiment of the present invention is viewed.

With reference to FIG. 7, an example of the specific object viewed according to an angle of a human looking at is shown.

That is, if an image of a vehicle is represented in the light emitting unit 200, the image viewed from the front of the light emitting unit 200 is an image of the front of the vehicle, and the image viewed from the side of the light emitting unit 200 may be an image of the side of the vehicle.

In addition, when viewed from other angles, an image of the vehicle corresponding to the angle may be provided.

The handle part 300 of the luminous stick of emitting a three-dimensional image on the basis of an optical element according to the embodiment of the present invention supplies power to the rotating part 110 and the control unit 130 and may include a battery unit 140 mounted on the handle part 300.

The battery unit 140 may be mounted with a built-in battery, and it may be possible to use a separate battery inserted.

In addition, the handle part 300 may be provided in a form other than a handle form by providing a table base or a fixing clip.

Figure 2:
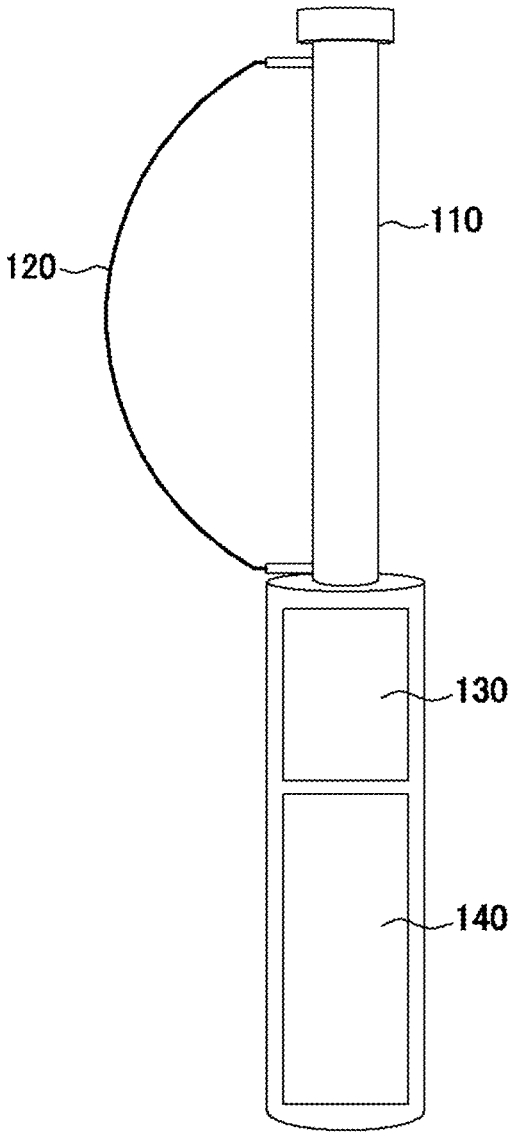
FIG. 2 is an example diagram showing an inside part of the luminous stick of emitting a three-dimensional image on the basis of an optical element according to the embodiment of the present invention.

As described in FIG. 2, the control unit 130 may be provided in a form in which it is mounted inside the handle part 300.

The control unit 130 may be disposed in the light emitting unit 200 or the rotating part 110, provided to rotate together with the rotating part 110, and the handle part 300 may be provided so as not to rotate.

That is, even if the control unit 130 is mounted on the handle part 300, it may be provided by securing a predetermined space to be able to rotate together with the rotating part 110 located above.

By mounting the control unit 130 on a support member of a region close to a sub-light emitting element 121, it may be provided so as to rotate together with the sub-light emitting element 121 in the same direction.

In addition, the control unit 130 is a printed circuit board (PCB) for controlling a signal on the sub-light emitting element 121. The control unit 130 may be disposed to rotate together with the sub-light emitting element 121 without the handle part, close to the sub-light emitting element 121, without being disposed below the rotating part or on a handle part.

Accordingly, it may be possible to easily control the signal for the sub-light emitting element 121, and it is possible to have an effect on convenience, yield improvement, and manufacturing cost reduction in the manufacturing process.

In addition, the battery unit 140 may be provided so as not to rotate even if the rotating part 110 and the control unit 130 rotate separately from the rotating part 110 and the control unit 130. In this case, the control unit 130 (that is, PCB) is formed close to the light emitting body 120 such that it is possible to easily control a signal of the light emitting body 120, and since it is possible to easily manufacture it in the manufacturing process, it is possible to improve production yield or reduce manufacturing costs.

Positions of the rotating part 110 and the control unit 130 are only examples for explaining of an embodiment of the present invention, it may be manufactured and changed inside the handle part 300, and the control unit 130 may be provided in a structure that does not rotate together with the rotating part 110, according to the position.

According to a further embodiment of the present invention, when the light emitting body 120 is provided in the "U" shape or the "O" shape, the light emitting body 120 may be provided with a supporting member of the "U" shape or the "O" shape, and it may be connected to the battery unit 140 through the supporting member.

At this time, the supporting member may be rotated by the rotating part, and the control unit 130 may be located at a position close to the light emitting body 120 by being mounted inside the supporting member.

Figure 3:
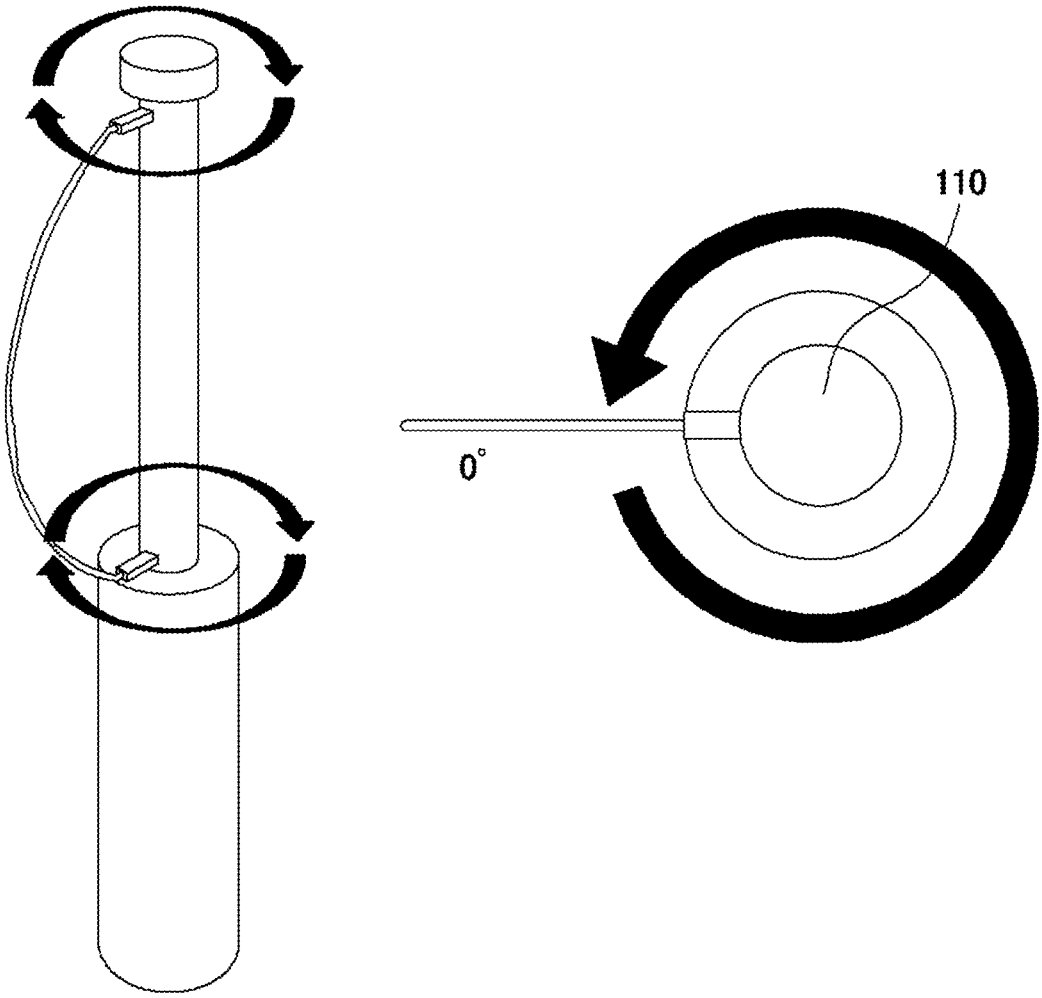
FIG. 3 is an example diagram showing an operation of the luminous stick of emitting a three-dimensional image on the basis of an optical element according to the embodiment of the present invention.

FIG. 3 is an example diagram showing the rotation of the luminous stick of emitting a three-dimensional image on the basis of an optical element according to the embodiment of the present invention.

With reference to FIG. 3, the rotating part 110 includes a rod shape rotation shaft, and both ends of the light emitting body 120 may be rotated by being fixed to the both ends of the rotation shaft.

That is, both ends of the rotating part 110 and both ends of the light emitting body 120 of a two-dimensional line or surface shape are fixed and rotated in place, and it may be possible to provide (reproduce or display) an image by forming a spherical three-dimensional light emitting region 400 according to the rotation of the light emitting body of the two-dimensional line or surface shape.

At this time, the light emitting body may be rotated at a frequency higher than a frequency at which a person can recognize the rotation of the light emitting body.

It is preferable that the light emitting body may rotate at a frequency of 60 Hz or more, and in this case, human can view a clear image from a rotating light emitting body.

Hereinafter, with reference to FIG. 4, the light emitting body and the control unit of the luminous stick of emitting a three-dimensional image on the basis of an optical element according to the embodiment of the present invention will be described in detail.

Figure 4:
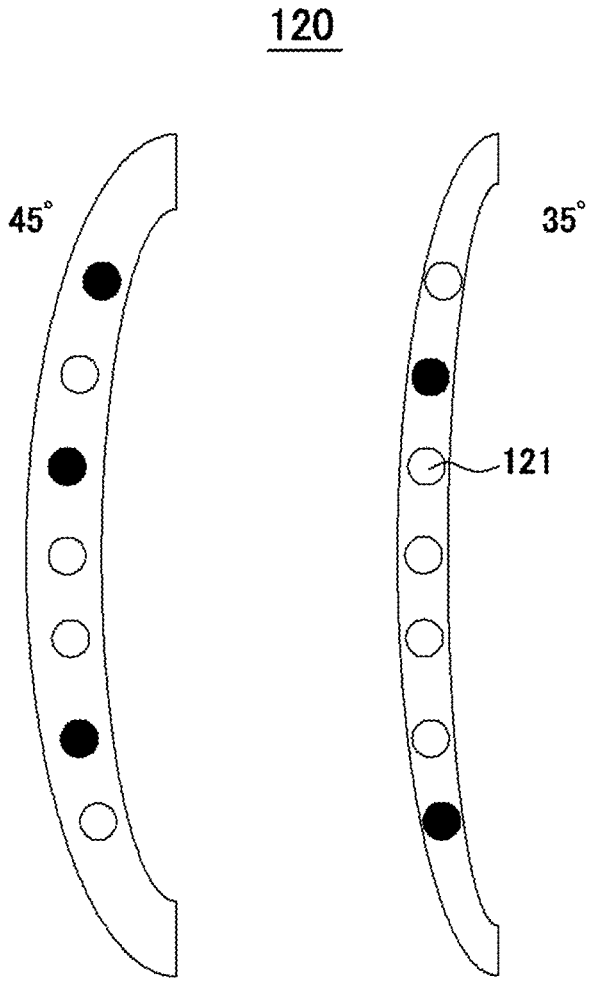
FIG. 4 is an example diagram showing a state where a light emitting body of the luminous stick of emitting a three-dimensional image on the basis of an optical element is varied based on a light emission angle according to the embodiment of the present invention.

FIG. 4 is an example diagram showing the light emitting body 120 of the luminous stick of emitting a three-dimensional image on the basis of an optical element according to the embodiment of the present invention, and an example diagram showing light emission at 45° and light emission at 35°.

As shown in FIG. 3, in the light emission angle of the light emitting body 120, a point at which rotation starts may be 0°, and a light emission angle may be selected in a rotation direction from the point at which rotation starts.

That is, since the luminous stick 100 of emitting a three-dimensional image on the basis of an optical element according to the embodiment of the present invention can be operated by supplying power to the rotating part 110 and the control unit 130, a point at which the light emitting body 120 is positioned may be 0° when the rotation starts by supplying the power.

The light emitting body 120 of the luminous stick of emitting a three-dimensional image on the basis of an optical element according to the embodiment of the present invention includes the plurality of sub-light emitting elements 121, the plurality of sub-light emitting elements 121 are provided at predetermined intervals, at least two sub-light emitting elements 121 may emit light of different colors, and each sub-light emitting element may be a light emitting diode (LED) module.

However, the light emitting body 120 shown in FIG. 4 is not limited to the drawing for describing an embodiment of the present invention, the interval may not be constant, and a larger number of sub-light emitting elements 121 may be provided.

Alternatively, the light emitting body 120 may be formed of an optical fiber. The optical fiber may not express discretely various colors in one optical fiber, as several LED modules of different colors are arranged, but may also be expressed by varying saturation or contrast.

The light emitting body 120 may be controlled by the control unit 130, the control unit 130 collects a rotation angle through a motor for rotating the rotating part 110 and the control unit 130 may provide a control signal to the light emitting body 120 to emit a predetermined color at a specific position in the light emitting body 120 when the light emitting body 120 is located at a specific rotation angle according to a predetermined light emission algorithm.

Here, the motor may be a servomotor, preferably to be able to identify the rotation angle and the number of rotations, and may be possible to collect them directly from the motor.

The predetermined light emission algorithm may be differently determined according to an image and a moving image to be reproduced through the luminous stick, as shown in FIG. 4, the sub-light emitting elements arranged in the first, third, and sixth positions from the top may emit light at a position of 45°, and the light emitting elements arranged in the second and eighth positions from the top may emit light at a position of 35°.

That is, the control unit 130 may set the light emission angle according to an angle at which the light emitting body 120 rotates based on information about image and a moving image to be reproduced, and may provide a control signal for emitting the light emitting body 120 by determining a light emission time and a light emission position for the plurality of sub-light emitting elements 121 provided in the light emitting body 120 according to a predetermined light emission angle.

When the control unit 130 cannot collect the rotation angle directly from a motor of the rotating part 110, the rotating part 110 includes a rotating body and a rotating body peripheral portion including the material having the magnetic force on one side configured to surround the rotating body. When the rotating body and the material having the magnetic force are disposed at positions corresponding to each other, it is set that a rotation angle is 0°, and the rotation angle may be measured based on the set angle.

That is, when the rotating body including the material having the magnetic force on one side rotates in the rotating body peripheral portion including the material having the magnetic force on one side and when the materials having the magnetic force are arranged (that is, facing each other) at positions corresponding to each other, a magnetic force is generated, and it may be determined that the rotation angle is 0° when the magnetic force is generated.

At the start of the rotation, even if the positions are not corresponding to each other, since the rotating body is rotated in place in the rotating body peripheral portion, a moment in which the materials having the magnetic force provided on each side face each other may be generated.

At this time, the control unit 130 may determine that the rotation angle is 0° when the magnetic force is generated due to the materials having the magnetic force facing each other or the magnetic force is temporarily formed.

In addition, the control unit 130 may provide an animation effect on an image provided through the rotation of the light emitting body 120 or vary the image by changing the light emission time and the light emission color of the light emitting body 120 even at the same light emission angle.

For example, when the light emitting body 120 emits light with respect to the same sub-light emitting element 121 at the same rotation angle every time, it is possible to show an image which is stopped at all times. However, when the light emitting body 120 changes the sub-light emitting element 121 to emit light at different positions at the same light emission angle every 1 second, 2 seconds, and 3 seconds, it may be possible to provide a moving image in a continuous time.

That is, not only a fixed image but also a moving image such as video, it may be possible to provide and reproduce a control signal to have different light emission positions and light emission times at the same rotation angle.

Hereinafter, with reference to FIG. 5 and FIG. 6, the three-dimensional light emitting region 400 of the luminous stick of emitting a three-dimensional image on the basis of an optical element according to the embodiment of the present invention will be described in detail.

Figure 5:
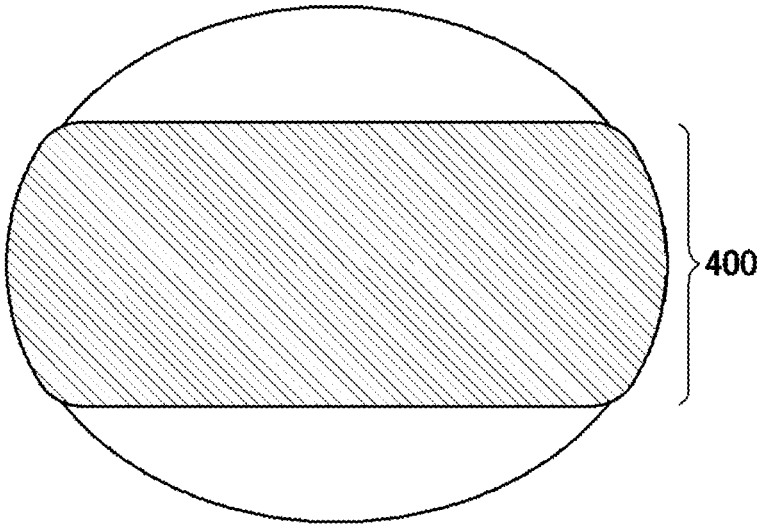
FIG. 5 is an example of a front view on a three-dimensional light emitting region of the luminous stick of emitting a three-dimensional image on the basis of an optical element according to the embodiment of the present invention.

FIG. 5 shows a region in which the three-dimensional light emitting region 400 is formed when looking at the luminous stick of emitting a three-dimensional image on the basis of an optical element according to the embodiment of the present invention from the front.

The three-dimensional light emitting region 400 means a region in which an image is displayed by the rotation of the light emitting body 120, and may be formed at some regions on a surface of a three-dimensional structure formed by rotating the light emitting body 120.

Meanwhile, some regions may be formed near the center of the surface of the three-dimensional structure, but may not be formed in one region of the upper portion and one region of the lower portion of the surface of the three-dimensional structure. At this time, since the three-dimensional structure is a structure formed by the rotation, the structure may be a structure having a symmetrical shape with respect to the central axis.

The structure of the symmetrical shape is merely an example for describing an embodiment of the present invention, and not limited thereto. The three-dimensional structure may have a non-symmetrical shape.

That is, as shown in FIG. 5, the three-dimensional light emitting region may be formed at some regions on the surface of a three-dimensional structure and may be formed near the center, and a size of the region in which the three-dimensional light emitting region 400 is formed may be formed differently according to types of the provided image and moving image.

Figure 6:
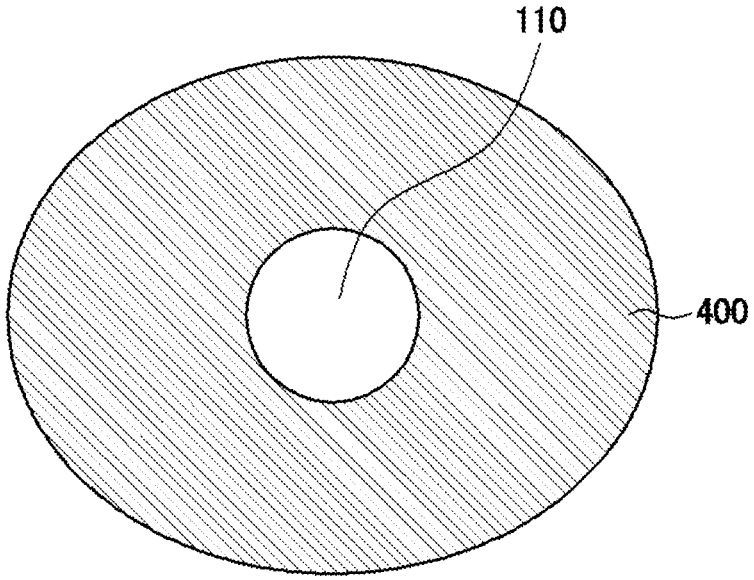
FIG. 6 is an example of the top side on the three-dimensional light emitting region of the luminous stick of emitting a three-dimensional image on the basis of an optical element according to the embodiment of the present invention.

FIG. 6 shows a region in which the three-dimensional light emitting region is formed when looking at the luminous stick of emitting a three-dimensional image on the basis of an optical element is viewed from an upper side.

As described in FIG. 5, since the three-dimensional light emitting region 400 is formed near the center, the three-dimensional light emitting region 400 may be formed in a circle shape in which the center is hollowed at a predetermined interval with respect to the upper end surface of the rotating part 110 when viewed from the upper side.

As a further embodiment of the present invention, only one end of the light emitting body may be configured to be fixed to the rotation shaft.

For example, as a propeller, it may be provided in a form in which the center of the light emitting body 120 is fixed to the rotation shaft and rotates, and one end may be fixed.

In this case, since it is possible to increase a region in which the three-dimensional light emitting region 400 is formed and it may be possible to implement various three-dimensional effects.

FIG. 7 is an example diagram showing a state in which different images are provided according to a position or angle of a human looking at the luminous stick of emitting a three-dimensional image on the basis of an optical element according to the embodiment of the present invention.

As shown in FIG. 7, when viewed from the front, the entire text of "I LOVE Y" may be viewed, and when viewed from a position of 90°, only the text of "E YOU ♥" may be viewed.

Since the luminous stick 100 of emitting a three-dimensional image on the basis of an optical element according to the embodiment of the present invention generates the three-dimensional light emitting region 400 on the spherical surface formed by rotating the light emitting body 120, the image shown may be different depending on a viewing angle or position, and an image viewed when viewed from an angle at which the image is actually viewed, may be provided.

That is, since the three-dimensional light emitting region 400 is formed by rotating the light emitting body 120, it may be formed by the curvature of the surface, and thus, the color and shape may be different depending on the viewing angle.

As a further embodiment of the present invention, in the luminous stick of emitting a three-dimensional image on the basis of an optical element according to an embodiment of the present invention, the handle part 300 may include a hole into which a memory device such as a USB and an SD card is inserted.

When a file such as an image or a moving image is provided to the control unit 130 by inserting the memory device through the hole provided in the handle part 300, the control unit 130 may set and algorithmize the light emission angle, the light emission position, and the light emission time of the light emitting body by referring a corresponding file to be reproduced through the luminous stick.

In addition, it may be possible to supply power to the battery unit 140 through the hole provided in the handle part 300. For example, when an external device including a USB port to be connected to a USB terminal is connected to the handle part 300, power may be supplied.

As another embodiment of the present invention, the luminous stick of emitting a three-dimensional image on the basis of an optical element according to an embodiment of the present invention may further include a communication module.

The communication module may be a module equipped with Bluetooth (BLE, Bluetooth Low Energy), NFC, RFID, Ultrasonic, Infrared, Wi-Fi, LiFi, and the like, and may communicate with terminals such as a smartphone, a tablet PC, and the like through the communication module.

For example, in order to perform the performance, when it is necessary to designate the image of the luminous stick in a specific position, it may be possible to control it through a terminal capable of communication.

In addition, when recognizing a specific QR code, it may be possible to provide an image corresponding to the recognized QR code.

Figure 8:
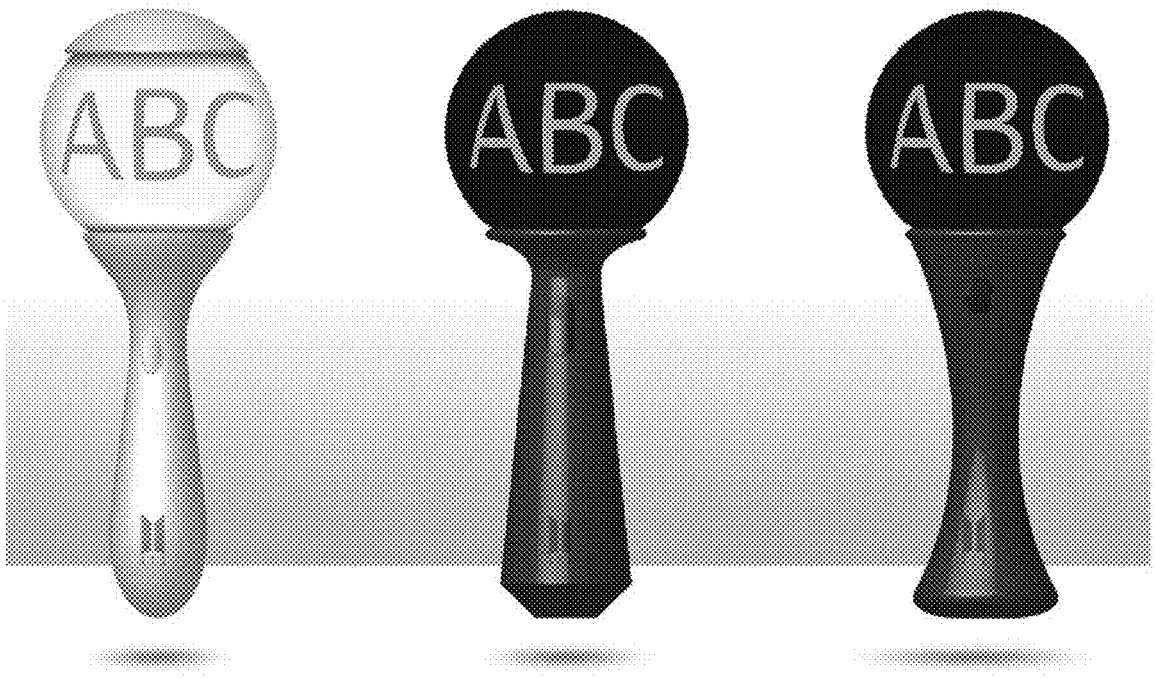
FIG. 8 is an example diagram of the luminous stick of emitting a three-dimensional image on the basis of an optical element according to the embodiment of the present invention.

FIG. 8 is an example diagram showing the luminous stick of emitting a three-dimensional image on the basis of an optical element according to an embodiment of the present invention.

In order to describe the embodiment of the present invention, the phrase "ABC" is inserted, but not limited thereto. Various phrases may be inserted, and, as described above, an image or a moving image may be reproduced.

With reference to FIG. 8, the shape of the handle part 300 is different, the luminous stick of a different shape from the shape of the protective case 150 is shown, which is only an example for explaining the embodiment of the present invention, and the appearance of the luminous stick of emitting a three-dimensional image on the basis of an optical element may be provided in various forms.

Figure 9:
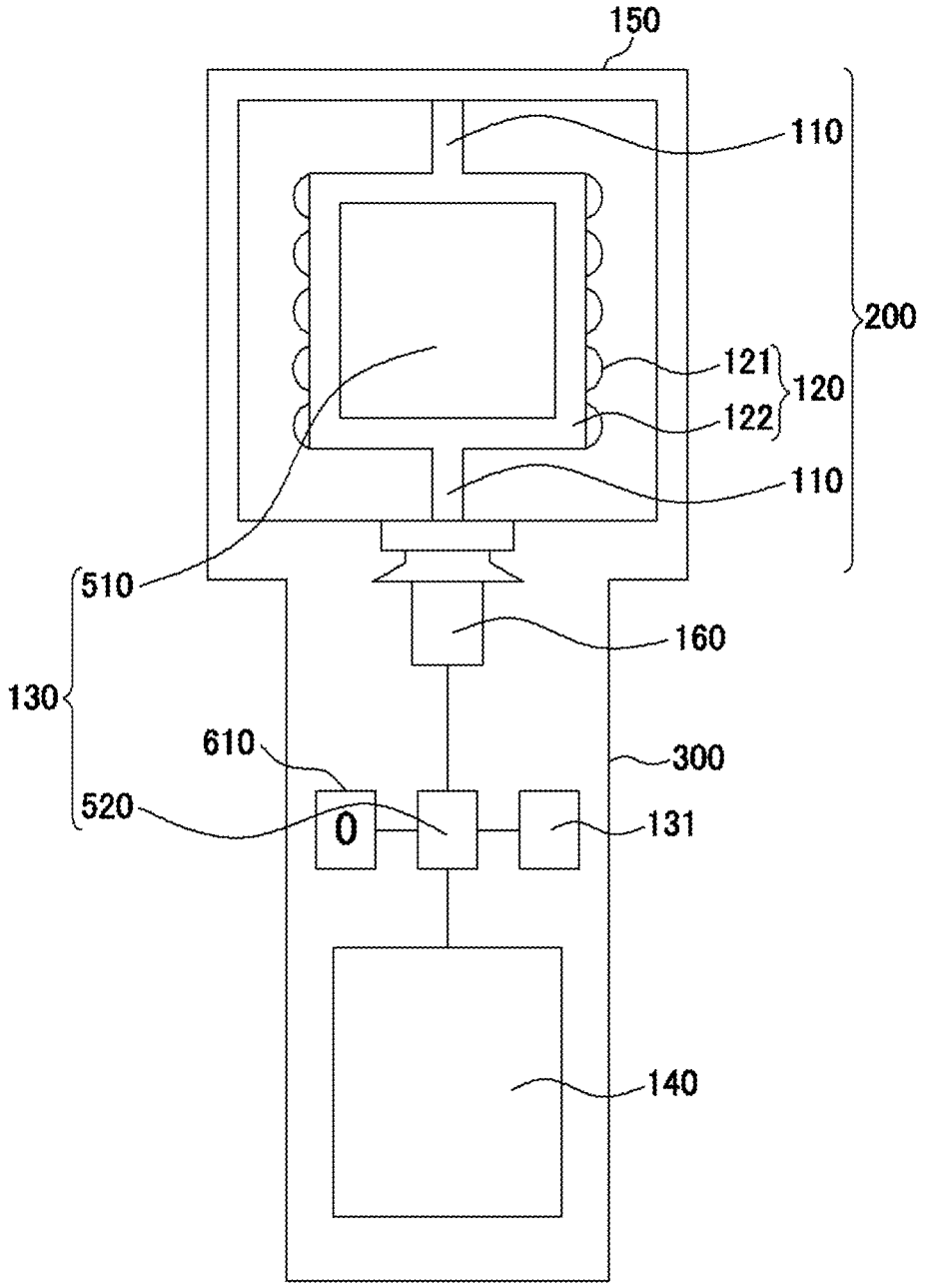
FIG. 9 is an example diagram of a luminous stick of emitting a three-dimensional image on the basis of an optical element according to a further embodiment of the present invention.

Hereinafter, with reference to FIG. 9, the luminous stick of emitting a three-dimensional image on the basis of an optical element according to a further embodiment of the present invention will be described in detail.

The light emitting body 120 of the luminous stick of emitting a three-dimensional image according to a further embodiment of the present invention may be provided as the plurality of sub-light emitting elements 121 that emit at least one color.

At this time, the light emitting body 120 may include a supporting member 122 having a rectangular shape (shown in FIG. 9) as shown, and a plurality of sub-light emitting elements 121 on both sides of the supporting member 122. The light emitting body 120 may form the three-dimensional light emitting region 400 of a three-dimensional shape by rotating it inside the luminous stick 100. On the other hand, the supporting member 122 may be formed in various shapes as well as the shape shown in the drawing, and may be provided in a flat plate shape.

The rotating part 110 rotating the light emitting body 120 may be positioned on the central axis of the luminous stick 100 (on central axis of light emitting body 120), and the upper end may be connected and fixed to the protective case 150 and the lower end may be connected and fixed to a motor 160.

Since the light emitting body 120 is configured to be symmetrical with respect to the rotating part 110, the rotating part 110 may be configured to extend from the center portion of the light emitting body 120.

Accordingly, both ends of the light emitting body 120 and both ends of the rotation shaft may be fixed to correspond to each other.

As a result, when the light emitting body 120 rotates, by fixing the light emitting body 120 with the upper end and the lower end of the rotation shaft, since it is possible to prevent a phenomenon that the light emitting body 120 protrudes due to the centrifugal force of the light emitting body 120 can be prevented, it may be possible to significantly reduce vibration of the light emitting apparatus.

The luminous stick of emitting a three-dimensional image according to a further embodiment of the present invention includes the control unit 130, and the control unit 130 may be configured with two PCB mounted therein.

A first PCB 510 that controls the light emission color and a light emission frequency of the plurality of sub-light emitting elements 121 and controls the motor 160 of rotating the rotating part 110 may be provided to be mounted inside the light emitting body 120.

The motor 160 controlled by the first PCB 510 may rotate the light emitting body 120 at a speed of 1200 Rpm to 1600 Rpm to form the three-dimensional light emitting region 400 by rotating the light emitting body 120, but this is only a speed for a preferred embodiment, and the present invention is not limited thereto.

In addition, the motor 160 may be positioned between the protective case 150 and the handle part 300. As a result, even when the rotating part 110 rotates, the handle part 300 may be provided not to rotate.

In addition, the handle part 300 may include a speaker 610 capable of outputting audio.

The second PCB 520 may be positioned in the handle part 300, may be connected to a switch 131 of turning on and off the power of the luminous stick 100, and may control the speaker 610.

The switch 131 may be able to provide different control signals, depending on the number of times the switch is pressed.

That is, according to the number of times the switch 131 is pressed, it may be controlled to play an image corresponding to a predetermined scenario, and the scenario may be changed by a user.

For example, when the switch 131 is pressed once, it may be controlled to provide a still image of the first scenario, and when pressed twice, it may be controlled to provide a moving image (three-dimensional image, animation, or the like) of a person of the second scenario, when pressed three times, it may be controlled to provide the moving image and music of the third scenario, and when pressed four times, it may be controlled to turn off the power.

At this time, the moving image and the music may be provided in synchronization with each other. For example, when the moving image of a music video is played, the music may be reproduced in synchronized with the shape of the mouth of a person in the moving image.

By applying a specific signal to the first and second PCBs 510 and 520 based on the input of the switch 131, and generating a corresponding signal from the first and second PCBs 510 and 520, it may be possible to perform light emitting according to the above-described scenarios.

The control scenario according to the number of times the switch 131 is pressed is only for explaining the embodiment of the present invention, and is not limited thereto, and it is obvious to those skilled in the art that different scenarios may be applied to the user or manufacturer as needed.

The battery unit 140 may be mounted with a built-in battery, and it may be possible to use a separate battery inserted.

That is, the luminous stick 100 of emitting a three-dimensional image according to a further embodiment of the present invention is configured to include the first PCB 510 that controls the light emitting body 120 and the motor 160 and the second PCB 520 that controls the power of the luminous stick 100 and the speaker 610.

In addition, the shape of the light emitting body may be provided in a form of a figure which may include the plurality of sub-light emitting elements 121 on both sides instead of a band shape, and the light emitting body 120 may be fixed by the rotation shaft of the rotating part 110.

Figure 10:
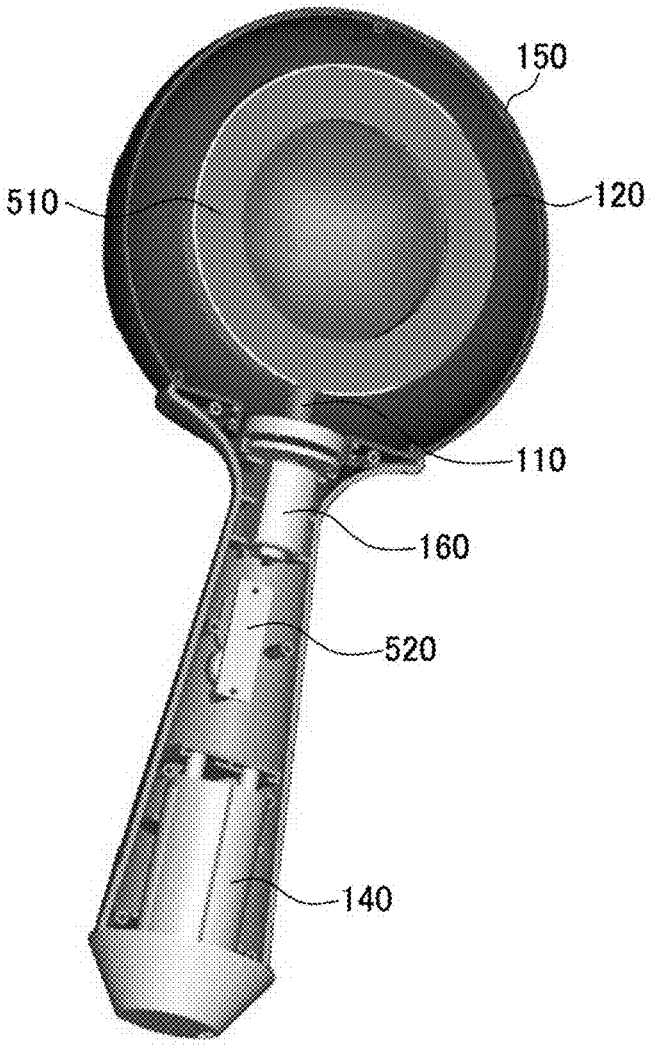
FIG. 10 is another example diagram of a luminous stick of emitting a three-dimensional image on the basis of an optical element according to a further embodiment of the present invention.

Meanwhile, FIG. 10 shows a light emitting apparatus according to another embodiment of the present invention. The light emitting apparatus of FIG. 10 differs in that the supporting member of the light emitting body is formed in a circle shape and the rotating part is connected at the bottom of the light emitting body, and the other components are the same.

Although the method and system of the present invention have been described in connection with specific embodiments, some or all of their components or operations may be implemented using a computer system having a general purpose hardware architecture.

The above description of the present invention is intended for illustration, and it will be understood by those skilled in the art that the present invention may be easily modified in other specific forms without changing the technical spirit or essential features of the present invention. Therefore, it should be understood that the embodiments described above are exemplary in all respects and not restrictive. For example, each component described as a single type may be implemented in a distributed manner, and similarly, components described as distributed may be implemented in a combined form.

The scope of the present invention is shown by the following claims rather than the above description, and all changes or modifications derived from the meaning and scope of the claims and their equivalents should be construed as being included in the scope of the present invention.

What is claimed is:

1. A luminous stick of emitting a three-dimensional image on the basis of an optical element comprising:

a light emitting unit;

a protective case enclosing the light emitting unit; and a handle part that supports the light emitting unit, wherein the light emitting unit includes a light emitting body that emits at least one color and include a plurality of sub-light emitting elements and a supporting member which accommodates the sub-light emitting elements, a rotating part that is positioned on a central axis of the light emitting body, a motor rotating the rotating part; and a control unit that generates a control signal for controlling a light emission position at which a specific color is to be emitted and a light emission angle at which the specific color is to be emitted on a rotation shaft in the light emitting body, and provides the control signal to the light emitting body, the light emitting body includes a three-dimensional light emitting region of a three-dimensional shape according to rotation, wherein the three-dimensional light emitting region is formed at some regions on a surface of a three-dimensional structure formed by rotating the light emitting body and is formed near center of the surface of the three-dimensional structure, the three-dimensional structure is a structure having a symmetrical shape with respect to a central axis thereof, the control unit controls the light emission position and the light emission angle so as to view another image of a specific object according to an angle of a person looking at the light emitting body when the specific object is reproduced through the rotation of the light emitting body, the rotating part connects an upper center of the supporting member with the protective case, and connects a lower center of the supporting member with the motor, so that a central axis of the supporting member is fixed at positions corresponding to both ends of the rotation shaft of the rotating part, the supporting member has a symmetrical shape with respect to the central axis, and the control unit is provided in a position adjacent to the plurality of sub-light emitting elements on the supporting member so as to rotate in the same direction together with the sub-light emitting elements, controls light emission color and light emission period of the sub-light emitting elements, and generates a control signal for the motor.

2. The luminous stick of emitting a three-dimensional image on the basis of an optical element according to claim 1, further comprising:

wherein the protective case has a volume wider than that of the three-dimensional light emitting region, and is provided with a material which can transmit light emitted from the light emitting body.

3. The luminous stick of emitting a three-dimensional image on the basis of an optical element according to claim 1, further comprising:

a battery unit that supplies power to the motor and the control unit and is mounted on the handle part, wherein the rotating part rotate at a frequency of 60 Hz or more.

4. The luminous stick of emitting a three-dimensional image on the basis of an optical element according to claim 3, wherein the control unit is connected with the light emitting body to rotate by the rotating part, and the handle part is not rotated.

5. The luminous stick of emitting a three-dimensional image on the basis of an optical element according to claim 1, wherein the rotating part includes the rotation shaft of a rod shape, and both ends of the light emitting body are rotated by being fixed to both ends of the rotation shaft.

6. The luminous stick of emitting a three-dimensional image on the basis of an optical element according to claim 1, wherein the control unit collects a rotation angle through a motor for rotating the rotating part and provides a control signal to the light emitting body to emit a predetermined color at a specific position in the light emitting body when the light emitting body is located at a specific rotation angle according to a predetermined light emission algorithm, the rotating part includes a rotating body and a rotating body peripheral portion including a material having magnetic force on one side configured to surround the rotating body, and the rotating part sets the rotation angle as 0° when the rotating body and the material having the magnetic force are arranged at positions corresponding to each other and measures the rotation angle based on the set angle.

7. The luminous stick of emitting a three-dimensional image on the basis of an optical element according to claim 1, wherein the light emission angle is defined based on the rotation angle of the rotating part, and the control unit provides an animation effect on an image or a text provided through the rotation of the light emitting body or varies the image or the text by changing the light emission time and the light emission color of the light emitting body even at the same light emission angle.

8. The luminous stick of emitting a three-dimensional image on the basis of an optical element according to claim 1, wherein the some regions are not formed in one region of an upper portion and one region of a lower portion of the surface of a three-dimensional structure.

9. A luminous stick of emitting a three-dimensional image on the basis of an optical element comprising:

a light emitting unit;

a protective case enclosing the light emitting unit; and a handle part that supports the light emitting unit, wherein the light emitting unit includes a light emitting body that emits at least one color and include a plurality of sub-light emitting elements and a supporting member which accommodates the sub-light emitting elements, a rotating part that is positioned on a central axis of the light emitting body, a motor rotating the rotating part; and a control unit that generates a control signal for controlling a light emission position at which a specific color is to be emitted and a light emission angle at which the specific color is to be emitted on a rotation shaft in the light emitting body, and provides the control signal to the light emitting body, the light emitting body includes a three-dimensional light emitting region of a three-dimensional shape according to rotation, the control unit controls the light emission position and the light emission angle so as to view another image of a specific object according to an angle of a person looking at the light emitting body when the specific object is reproduced through the rotation of the light emitting body, the rotating part connects an upper center of the supporting member with the protective case, and connects a lower center of the supporting member with the motor, so that a central axis of the supporting member is fixed at positions corresponding to both ends of the rotation shaft of the rotating part, the supporting member has a symmetrical shape with respect to the central axis, and the control unit is provided in a position adjacent to the plurality of sub-light emitting elements on the supporting member so as to rotate in the same direction together with the sub-light emitting elements, controls light emission color and light emission period of the sub-light emitting elements, and generates a control signal for the motor, wherein the light emitting body includes a plurality of sub-light emitting elements, the plurality of sub-light emitting elements are provided at predetermined intervals, at least two sub-light emitting elements emit light of different colors, and a length of the sub-light emitting element is provided with a length longer than that of the rotation shaft and fixed in a curved form.

10. An apparatus of emitting a three-dimensional image through rotation of an optical element comprising:

a light emitting body that emits at least one color and include a plurality of sub-light emitting elements and a supporting member which accommodates the sub-light emitting elements;

a protective case enclosing the light emitting body;

a rotating part that is positioned on a central axis of the light emitting body;

a motor rotating the rotating part; and a control unit that generates a control signal for controlling a light emission position at which a specific color is to be emitted and a light emission angle at which the specific color is to be emitted on a rotation shaft in the light emitting body, and provides the control signal to the light emitting body, wherein the light emitting body includes a three-dimensional light emitting region of a three-dimensional shape according to rotation, wherein the three-dimensional light emitting region is formed at some regions on a surface of a three-dimensional structure formed by rotating the light emitting body and is formed near center of the surface of the three-dimensional structure, the three-dimensional structure is a structure having a symmetrical shape with respect to a central axis thereof, the control unit controls the light emission position and the light emission angle so as to view another image of a specific object according to an angle of a person looking at the light emitting body when the specific object is reproduced through the rotation of the light emitting body, the rotating part connects an upper center of the supporting member with the protective case, and connects a lower center of the supporting member with the motor, so that a central axis of the supporting member is fixed at positions corresponding to both ends of the rotation shaft of the rotating part, the supporting member has a symmetrical shape with respect to the central axis, and the control unit is provided in a position adjacent to the plurality of sub-light emitting elements on the supporting member so as to rotate in the same direction together with the sub-light emitting elements, controls light emission color and light emission period of the sub-light emitting elements, and generates a control signal for the motor.

* * * * *